US012134536B2

(12) United States Patent
Prims et al.

(10) Patent No.: US 12,134,536 B2
(45) Date of Patent: Nov. 5, 2024

(54) ROTARY FRAME CONSTRUCTION FOR WEB TRANSPORT CONTROL DEVICES

(71) Applicant: BST GmbH, Bielefeld (DE)

(72) Inventors: Ulrich Prims, Bielefeld (DE); Robin Lorenz, Herford (DE); Jörgen Schumacher, Herford (DE)

(73) Assignee: BST GmbH, Bielefeld (DE)

( * ) Notice: Subject to any disclaimer, the term of this patent is extended or adjusted under 35 U.S.C. 154(b) by 446 days.

(21) Appl. No.: 17/572,096

(22) Filed: Jan. 10, 2022

(65) Prior Publication Data

US 2022/0219928 A1 Jul. 14, 2022

(30) Foreign Application Priority Data

Jan. 13, 2021 (EP) ..... 21151274

(51) Int. Cl.
*B65H 23/038* (2006.01)
*B65H 23/035* (2006.01)

(52) U.S. Cl.
CPC ..... *B65H 23/038* (2013.01); *B65H 23/035* (2013.01); *B65H 2301/31124* (2013.01); *B65H 2404/15212* (2013.01)

(58) Field of Classification Search
CPC B65H 23/035; B65H 23/038; B65H 2403/51; B65H 2404/142; B65H 2404/15212
USPC ..... 226/21
See application file for complete search history.

(56) References Cited

U.S. PATENT DOCUMENTS 7,303,066 B2 * 12/2007 Rumer ..... B65H 23/02 198/831

FOREIGN PATENT DOCUMENTS

| | | | | |
|---|---|---|---|---|
| DE | 102009014477 A1 * | 9/2010 | ..... | B65G 39/16 |
| DE | 202017100819 U1 | 6/2018 | | |
| EP | 0092735 A2 | 11/1983 | | |
| EP | 0397030 B1 * | 11/1990 | ..... | B65H 23/038 |
| EP | 1362815 A2 | 11/2003 | | |
| JP | 2011241010 A | 12/2011 | | |

(Continued)

OTHER PUBLICATIONS

Ulrich; Prims, "Rotating Frame Construction for Web-Movement Control Devices" (English Translation), May 16, 2018, worldwide.espacenet.com (Year: 2018).*

(Continued)

*Primary Examiner* — Prasad V Gokhale
*Assistant Examiner* — Molly K Devine
(74) *Attorney, Agent, or Firm* — Richard M. Goldberg

(57) ABSTRACT

A rotary frame construction for web transport control devices, includes a carrier frame and a rotary frame in parallel therewith and carrying input and output rollers for a web and pivotably mounted on the carrier frame about a rotation center defined by control surfaces of one frame, the control surfaces scanned by cam followers on the other frame, the frames held in parallel alignment by support rollers on one frame and run surfaces on the other frame, the frames pivotally connected with one another by a drive system, the control surfaces constituted by three control curves formed at outer edges of a cam plate rigidly held on one frame, two of the control curves located on one side of the cam plate and the third on the opposite side of the cam plate, and the other frame has three cam followers respectively associated with one of the control curves.

15 Claims, 4 Drawing Sheets

(56) References Cited

FOREIGN PATENT DOCUMENTS

| | | |
|---|---|---|
| JP | 201286391 A | 5/2012 |
| TW | 201221459 A1 | 6/2012 |

OTHER PUBLICATIONS

Salomon; Volker, "Positioning Device for Web Guide Controller" (English Translation), Sep. 30, 2010, worldwide.espacenet.com (Year: 2010).*

Lindner; Johann, "Guiding Device for an Intermittently Moving Web" (English Translation), Nov. 14, 1990, worldwide.espacenet.com (Year: 1990).*

* cited by examiner

ROTARY FRAME CONSTRUCTION FOR WEB TRANSPORT CONTROL DEVICES

BACKGROUND OF THE INVENTION

The invention relates to a rotary frame construction for web transport control devices, the rotary frame construction comprising a carrier frame and a rotary frame which extends in parallel with the carrier frame and carries an input roller and an output roller for a web to be controlled and is pivotably mounted on the carrier frame by means of a bearing, the bearing having a virtual rotation center that is defined by control surfaces of one of the carrier frame and the rotary frame, the control surfaces being scanned by cam followers on the other of the frames, the frames being held in parallel alignment by means of support rollers on one of the frames and associated run surfaces on the other frame, the frames being connected with one another so as to be pivotable by means of a drive system.

When running material webs are processed, for example in a rotary printing press, it is generally necessary to steer or feedback-control the movement of the web, in order to prevent the web from migrating in the direction transverse to the running direction. To that end, the web is threaded through the rotary frame construction such that it is respectively deflected, by 90° for example, at the input roller and at the output roller. If the running direction deviates from the desired direction, the rotary frame which carries the input roller and the output roller is rotated relative to the carrier frame such that the input and output rollers take another posture and steer the web back into the desired direction.

In most conventional rotary frame constructions, the input roller and the output roller are mounted, with their axes in parallel, on a plane that is parallel with the rotary frame but is offset from the plane of the rotary frame such that the rollers can rotate freely. The rotary frame and the carrier frame are approximately congruent and are also arranged in planes that are offset from one another, so that they can be pivoted relative to one another. Thus, as a whole, the rotary frame construction has a three-layer design.

The rotation center about which the rotary frame is pivoted relative to the carrier frame should ideally be positioned in the center of the incoming web, so that the pivotal axis is orthogonal to the plane of the rotary frame and extends tangentially with respect to the outer vertex of the input roller. In this way, it can be achieved that, when the rotary frame is pivoted, the incoming web remains practically stationary whereas the outgoing web is displaced in the desired direction.

A bearing with a virtual rotation center has the advantage that the ideal position for the pivotal axis can be realized without any mechanical axis or bearing elements that could collide with the incoming web being present in this position.

A rotary frame construction of the type described above has been disclosed in DE 20 2017 100 819 U1. The control surfaces that define the virtual rotation center are formed by cylindrically curved walls that are centered on the virtual rotation center. The corresponding cam followers are formed by sets of follower rolls which run on both, the concavely curved side and the convexly curved side of the walls, so that the degrees of freedom of motion in the plane parallel with the frame are reduced to one degree of freedom of rotation. The run surfaces for the support rollers are formed by support sheets that extend in parallel with the frame, and the support rollers are respectively arranged on both sides of the support sheet and run on both surfaces of the support sheet, so that the frames are held in a fixed position in the direction normal to the planes of the frames and cannot be tilted about an axis extending in parallel with the plane of the frame, neither.

SUMMARY OF THE INVENTION

It is an object of the invention to provide a rotary frame construction that has a simplified design.

According to the invention, in order to achieve this object, the control surfaces are constituted by three control curves that are formed at the outer edges of a cam plate that is rigidly held on one of the frames, two of the control curves being located on one side of the cam plate and the third on the opposite side of the cam plate, and the other of the frames has three cam followers that are respectively associated with one of the control curves.

In the construction according to the invention, the control surfaces can simply be formed by a single plate which can be machined, for example by laser cutting, such that the edges of the plate form the control curves with the desired curvature. Since the cam followers, e.g. follower rolls, engage the control curves from opposite sides, the restriction of the degrees of freedom of motion in the direction parallel to the planes of the frames is achieved with only three cam followers. In this way, it is possible to achieve a low-resistance pivotal movement of the rotary frame, which movement can therefore be controlled precisely.

At the same time, a low constructional height of the frame construction (when installed horizontally) is achieved because at least parts of the carrier frame and the rotary frame, namely the cam plate and the cam followers, must be arranged in a common plane, and therefore additional design freedom is obtained for installing the rotary frame construction in a machine.

Useful embodiments of the invention are indicated in the dependent claims.

A particularly compact design can be achieved by arranging the carrier frame and the rotary frame approximately in a common plane, with the one frame (e.g. the rotary frame), surrounding the other frame (the carrier frame) with a certain spacing.

The cam plate can optionally be part of the rotary frame or part of the carrier frame. For simplicity, only the case that the cam plate forms part of the rotary frame shall be discussed in the description below. Then, the rotary frame, which surrounds the carrier frame with its outer legs, has a horizontal cross-bar on which the cam plate is arranged such that it is also surrounded by parts of the carrier frame on which the cam followers have been formed.

In a useful embodiment, the support rollers which assure the parallel alignment of the frames and are arranged for example on the carrier frame, are respectively accommodated with little play in a slot that is formed in the other frame (the rotary frame), with the parallel edges of the slot forming the run surfaces for the support rollers. In this way, a relative movement in the direction normal to the planes of the frames can be prevented already with a single support roller because this support roller can only move in the slot in the direction parallel with the plane of the frame. A little play between the support roller and the edges of the slot enables the support roller to roll with low friction on either the one or the other of the edges of the slot, depending upon which of the two edges of the slot the support roller is urged against. The play can be kept so low that it is smaller than the admissible tolerance for a relative movement of the frames in the direction normal to the planes of the frames.

This mechanism for parallel alignment of the frames can also be taken advantage of independently of the features of the claims as discussed above. Thus, the present disclosure encompasses also a rotary frame construction according to the claims, which is characterized in that each of the support rollers is accommodated with little play in a slot formed in the other frame and having parallel edges that constitute the run surfaces.

If the cam plate is held in a cross-bar that extends in parallel with the plane of the rotary frame, then the slots for the support rollers can be formed in connector parts that connect the cam plate to the cross-bar. In this way, a particularly simple design of the rotary frame construction can be achieved. The follower rolls that roll along the edges of the cam plate can be rotatably supported on a plate of the carrier frame so as to be rotatable about vertical axes (if the planes of the frames extend horizontally). This plate may also mount brackets which have vertical legs in which the support rollers that engage in the slots of the connector part are rotatably supported with horizontal axes of rotation.

Due to inevitable manufacturing tolerances, the bearing that defines the virtual rotation center has a certain bearing play that may compromise the accuracy of the web transport control. Also, the drive system that moves the rotary frame relative to the carrier frame in the one direction at one time and into the other direction at another time has generally a certain play. In a useful embodiment, the drive system is self-arresting at least in one direction. Then, both, the bearing play and the play in the drive system can easily be eliminated by elastically biasing the frames against one another and against the self-arresting force of the drive system. This feature can also be taken advantage of independently of the features of the claims. The present disclosure therefore encompasses also a rotary frame construction according to the claims which is characterized in that the drive system is self-arresting at least in one direction and the frames are elastically biased against one another in the rotary direction in which the drive system is self-arresting.

For example, the drive system may be a linear drive that acts between two levers that are formed on the two frames. The elastic bias may for example be achieved by means of a simple tension spring that draws the two levers together.

BRIEF DESCRIPTION OF THE DRAWINGS

An embodiment example will now be described in conjunction with the drawings, wherein.

DETAILED DESCRIPTION

Figure 1:
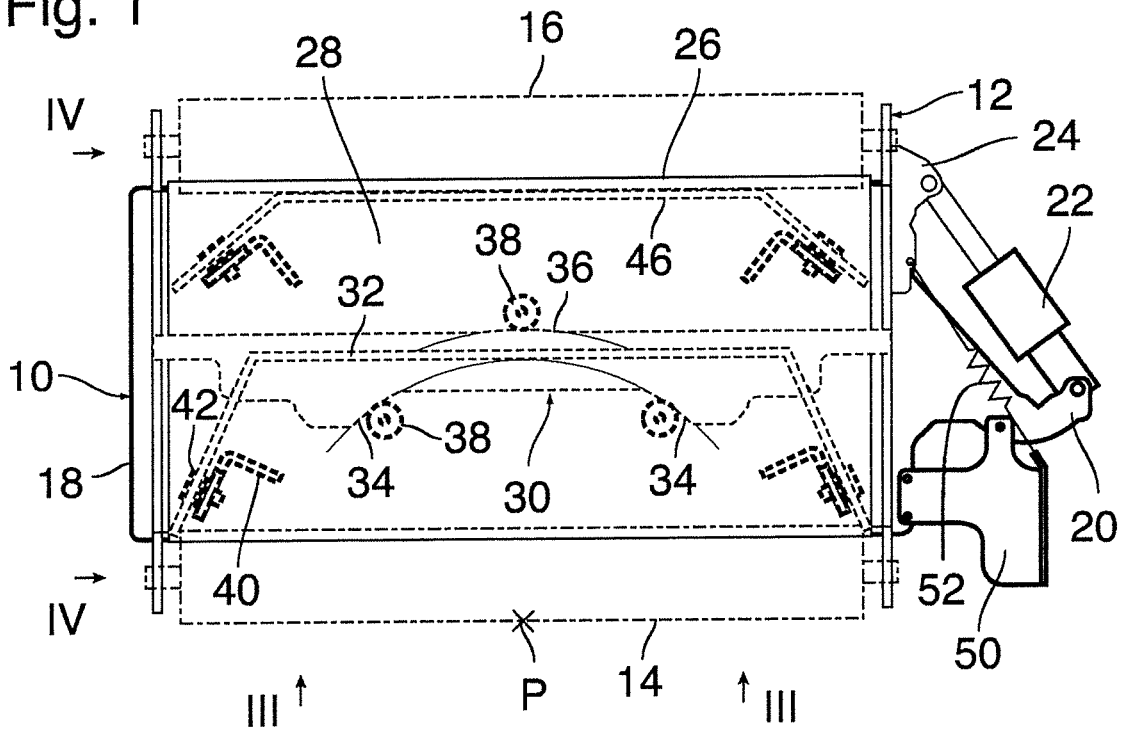
FIG. 1 is a schematic top plan view of a rotary frame construction.
Figure 2:
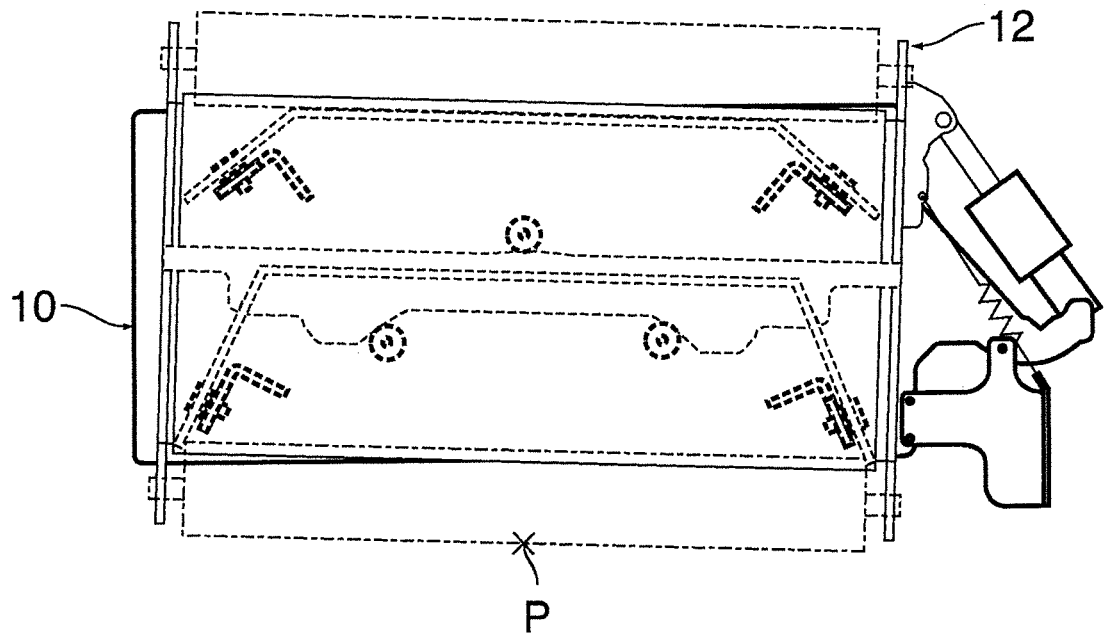
FIG. 2 shows the rotary frame construction with a slightly pivoted rotary frame.

FIG. 1 shows a top plan view of a rotary frame construction comprising a carrier frame 10 and a rotary frame 12 that are pivotable relative to one another about a virtual rotation center P. FIG. 2 shows the rotary frame construction with the rotary frame slightly pivoted. For ease of distinction, all parts that belong to the (stationary) carrier frame 10 have been shown in bolder lines than the parts that are movable with the rotary frame 12.

An input roller 14 and an output roller 16 are rotatably supported in the rotary frame 12, and a material web which has not been shown and the movement of which shall be steered by means of the rotary frame construction is threaded over the input and output rollers. For example, the material web may, in inverted U-thread, run upwards (in the direction towards the viewer in FIG. 1) to the input roller 14 where it is deflected in the horizontal direction so as to be passed-on to the output roller 16 where it is deflected again so that it will then move downwards.

The carrier frame 10 has a horizontal base plate 18 the greatest part of which is hidden by the rotary frame 12 in FIG. 1, so that only the left edge of the base plate 18 is visible. On the right side in FIG. 1, the base plate 18 forms a lever 20 that projects beyond the lateral edge of the rotary frame 12 and is connected to a bracket or a lever 24 of the rotary frame via an articulated linear drive 22. When the linear drive 22 draws the levers 20 and 24 together, the rotary frame 20 pivots about the vertical pivotal axis that passes through the rotation center P, as has been shown in FIG. 2. This pivotal axis forms a tangent to the input roller 14, so that the input roller and, therewith, the incoming material web does not make any lateral movement when the rotary frame 12 is rotated, whereas the output roller 16 and the outgoing material web are displaced in lateral direction.

The rotary frame 12 forms a gutter-shaped downwardly open casing 26 the top wall of which forms a cross-bar 28 for holding a cam plate 30 that is accommodated in the interior of the casing 26 and is connected to the cross-bar 28 by a wall member 32 that is trapezoidal in plan view. The edge of the cam plate 30 forms, on the bottom side in FIG. 1, two control curves 34 shaped as circular arcs and, on the top side, another control curve 36 shaped as a circular arc. The control curves 34 and 36 are centered on the virtual rotation center P. In order to illustrate the curvature of the control curves 34, 36 more clearly, FIG. 1 shows extended circular arc segments (continuous lines). Associated with each of the control curves 34, 36 is a follower roll 38 that is supported on the carrier frame 10 so as to be rotatable about a vertical axis. The three follower rolls 38 engage the edge of the cam plate 30 practically without play, so that this cam plate and, therewith, the entire rotary frame 12 can only perform a circular movement relative to the carrier frame about the virtual rotation center P.

Figure 8:
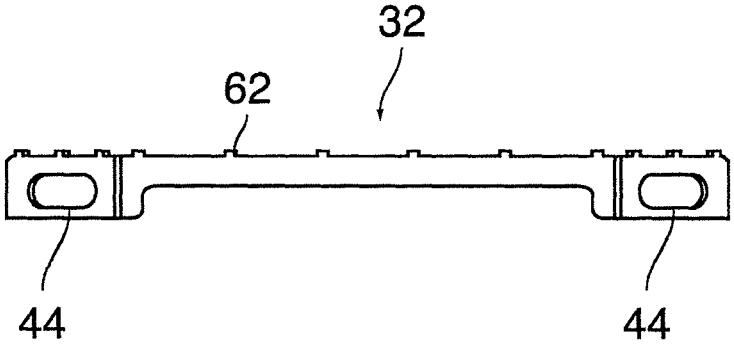
FIGS. 8 and 9 are front views of two fastening members for fastening a cam plate to the rotary frame.

Four brackets 40 that project vertically from the base plate and each support a support roller 42 have been welded onto the carrier frame 10. Two of these support rollers 42 are accommodated in slots 44 (FIG. 8) that extend horizontally in the legs of the trapezoidal wall member 32. These legs of the wall member 32 are angled such that they extend tangentially to an arc of a circle around the virtual rotation center P. If a downwardly directed force (weight) acts upon the rotary frame 12, then the top edges of the slots 44 are urged against the support rollers 42 so that the wall member 32 and, therewith, the entire rotary frame 12 are supported on the support rollers 42. When the rotary frame is pivoted, there is a relative movement between the support roller and the slot, and the support roller rolls along the top edge of the slot.

In the case that the rotary frame 20 is subject to an upwardly directed force, the lower edges of the slots 44 are urged against the support rollers 42, and in case of a pivotal movement, the support rollers will roll along these lower edges of the slots. The play of the support rollers 42 in the slots 44 is on the one hand so large that the support rollers can move with low friction and is on the other hand so small that the vertical movement of the wall member 32 relative to the support frame, as admitted by the play, remains within the admissible tolerances.

Figure 9:
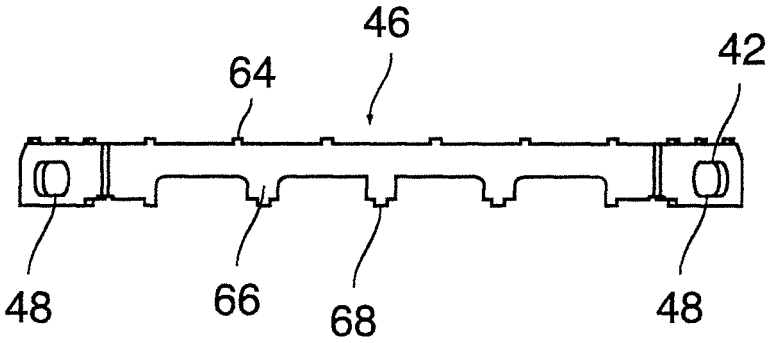

The casing 26 of the rotary frame 12 accommodates another wall member 46 that is trapezoidal in plan view and is fixed on the bottom side of the cross-bar 28, and slots 48 are formed in the angled legs of this wall member (FIG. 9). Two of the four support rollers 42 are accommodated in these slots of the wall member 46. The legs of this wall member are also angled such that they extend tangentially to an arc of a circle around the virtual rotation center P. The wall member 46 is therefore guided and supported with low play by the support rollers 42 in the same manner as the wall member 32. All in all, the engagement of the support rollers 42 in the slots 44, 48 prevents a vertical movement of the rotary frame relative to the carrier frame, and the rotary frame and the carrier frame are held in exact parallel alignment.

A holder 50 for one end of a tension spring 52 is mounted on the base plate 18 of the carrier frame and on the lever 20 formed by this base plate. The other end of the tension spring is anchored at the lever 24 of the rotary frame 12, so that a permanent tensioning force is produced that has the tendency to draw the levers 20 and 24 together and to rotate the rotary frame 12 counter-clockwise relative to the carrier frame 10. However, the linear drive 22 is self-arresting at least in the direction in which its length decreases, so that the torque exerted by the tension spring 52 does not actually cause a rotation of the rotary frame 12. However, the elastic bias that is caused by the spring 52 has the effect that any play in the bearing formed by the control curves 34, 36 and the follower rolls 38 as well as any play in the linear drive 22 and its articulated joints with the levers 20, 24 is eliminated.

When the machine of which the rotary frame construction described here forms part is operating, the lateral position of the material web is detected by means of a sensor, and the linear drive 22 is controlled by means of a controller such that the position of the material web is adjusted to a target value. In this feedback-control process, the linear drive 22 is alternatingly extended and retracted in order to rotate the rotary frame in the one direction or the other. The tension spring 52 assures that no hysteresis occurs in this control process because the spring will always hold all components of the system in which a certain play may occur at the same limit of the range of movement that is admitted by the play.

Figure 3:
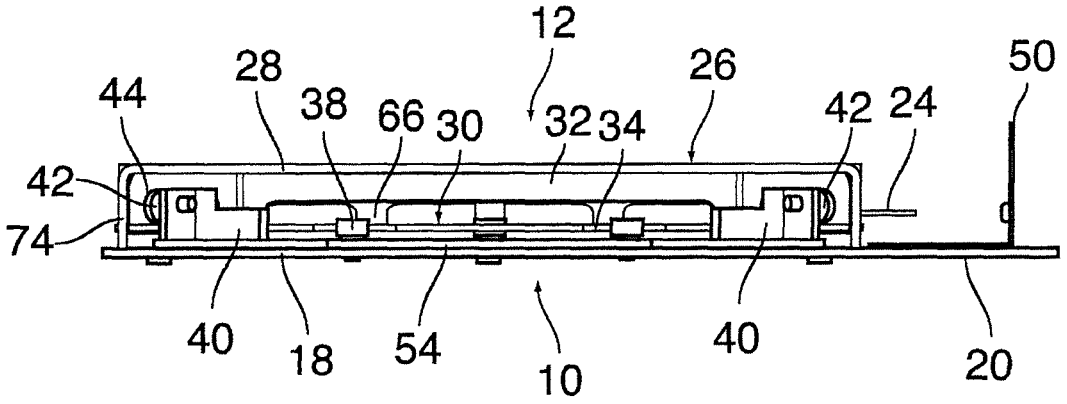
FIG. 3 is a view of the rotary frame construction as seen in the direction of arrows III-III in FIG. 1.
Figure 5:
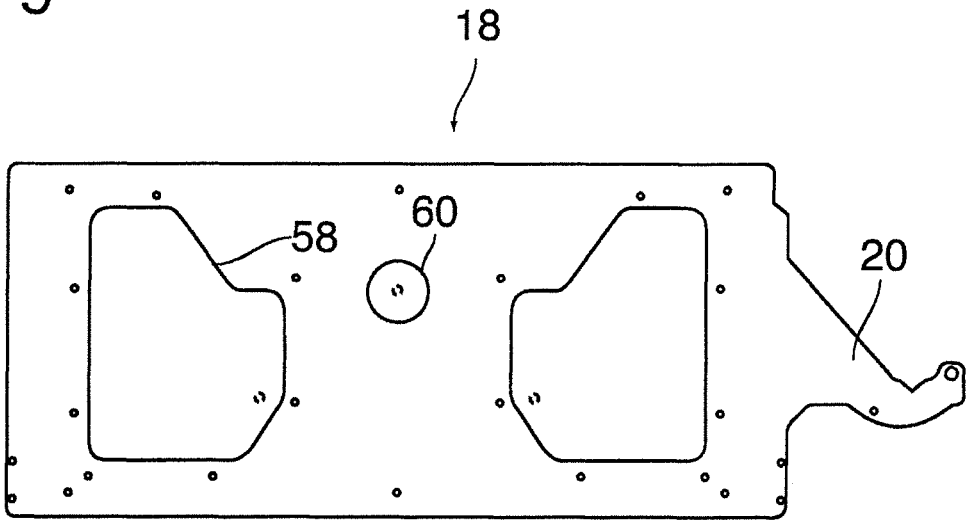
FIG. 5 is a plan view of a base plate of a carrier frame.
Figure 6:
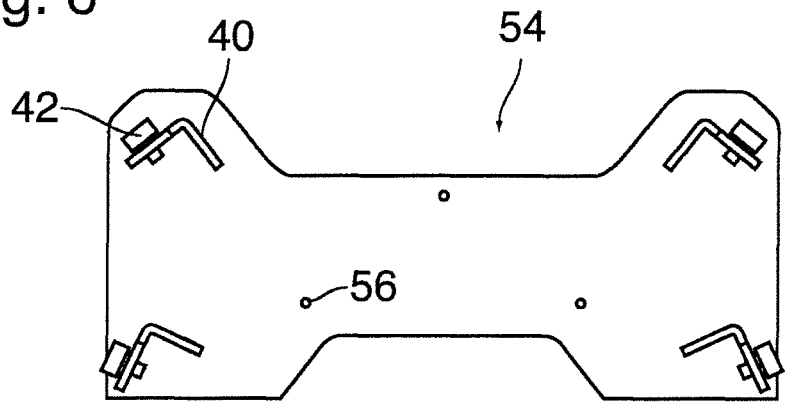
FIG. 6 is a top plan view of a support plate of the carrier frame.

FIG. 3 shows the rotary frame construction in a front view. Welded on the base plate 18 of the carrier frame 10 is a support plate 54 on which the follower rolls 38 are rotatably supported. The contours of the base plate 18 and the support plate 54 have been shown separately in FIGS. 5 and 6. FIG. 6 also shows bearing holes or bearing axles 56 for the follower rolls 38. In FIG. 5, the positions of these bearings axles have been shown in phantom lines. The base plate 18 has recesses 58, 60 which accommodate the ends of the bearing axles.

The brackets 40 for the support rollers 42 are also welded to the support plate 54. In order to assure an exact positioning and safe immobilization of the brackets 40, these brackets are formed, on the edge facing the support plate 54, with pegs which have not been shown and which engage in corresponding peg holes of the support plate 54.

Figure 7:
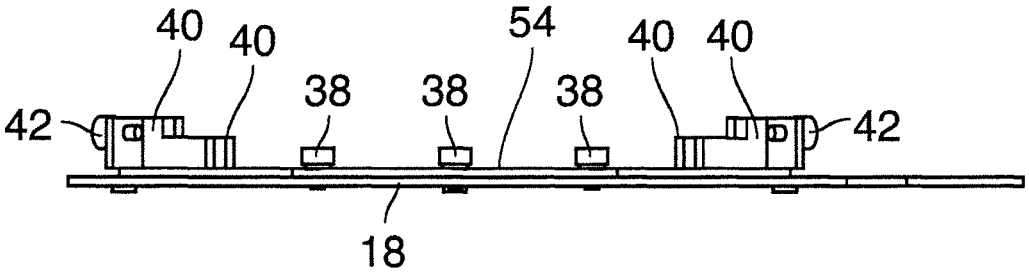
FIG. 7 is the front view of the carrier frame.

FIG. 7 shows the entire carrier frame in a front view. The wall member 32 with trapezoidal contour that forms the slots 44 for the support rollers 42 is visible in FIG. 3 and has been shown separately in FIG. 8. This wall member is also formed with projecting pegs at its top edge, the pegs engaging in corresponding peg holes (not shown) of the cross-bar 28.

FIG. 9 shows a front view of the wall member 46 forming the slots 48 for the two other support rollers 42. This wall member is also formed with pegs 64 at its top edge, for engagement into peg holes of the cross-bar 28.

Figure 10:
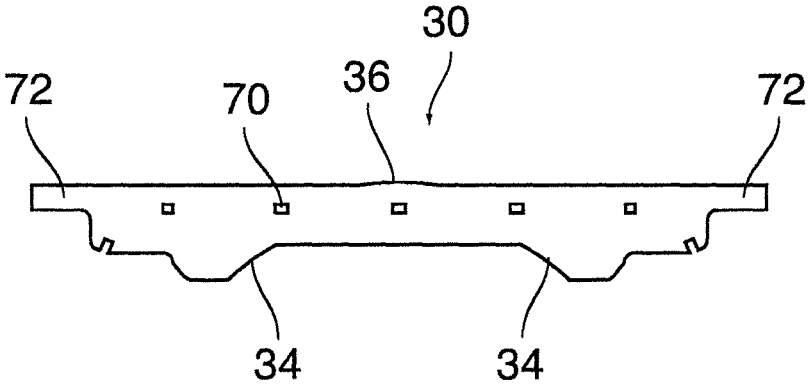
FIG. 10 is a plan view of the cam plate.

In FIG. 3, the wall member 46 is largely obscured by the wall member 32 that is disposed in front thereof, so that what is visible are only downwardly projecting studs 66 (FIG. 9). These studs are formed at their bottom ends with pegs 68 for engagement in peg holes 70 of the cam plate 30 a plan view of which has been shown separately in FIG. 10. The cam plate 30 is welded to the pegs 68 and is thereby immobilized in its position in the rotary frame 12. For further stabilization, the cam plate 30 has projections 72 at both ends, these projections being in form-fitting engagement with corresponding recesses in side walls 74 of the casing 28, as can be seen in FIG. 3.

Figure 4:
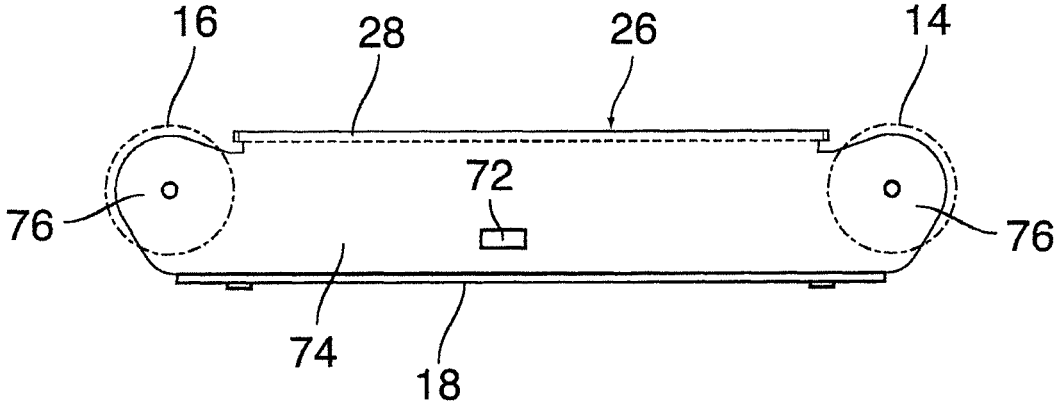
FIG. 4 is an enlarged side view of the rotary frame construction as seen in the direction of arrows IV-IV in FIG. 1.

FIG. 4 shows the rotary frame construction in a side view. Of the carrier frame, only the base plate 18 is visible here. The side walls 74 of the casing 26 of the rotary frame are prolonged at both ends to form bearing brackets 76 for the input roller 14 and the output roller 16. These bearing brackets may have different shapes, depending upon the desired type of threading of the material web. FIG. 4 shows the configuration for inverted U-thread. In this configuration, the entire constructional height of the rotary frame construction is only slightly larger than the diameter of the input and output rollers 14, 16. Moreover, FIG. 4 shows one of the projections 72 of the cam plate that penetrate the side wall 74.

What is claimed is:

1. A rotary frame construction for web transport control devices, comprising:

a carrier frame, a rotary frame which extends in parallel with the carrier frame and carries an input roller and an output roller for a web to be controlled, the rotary frame being pivotably mounted on the carrier frame by a bearing having a virtual rotation center that is defined by control surfaces of one of the carrier frame and the rotary frame, cam followers on the other of the frames for riding along the control surfaces, support rollers on one of the frames and associated run surfaces on the other frame for holding the frames in parallel alignment, a drive system, with the frames being connected with one another so as to be pivotable by means of the drive system, wherein the control surfaces are constituted by three control curves that are formed at outer edges of a cam plate that is rigidly held on one of the frames, with two of the control curves being located on one side of the cam plate and the third on an opposite side of the cam plate, and wherein the other of the frames has three said cam followers that are respectively associated with one of the control curves.

2. The rotary frame construction according to claim 1, wherein the cam plate forms part of the rotary frame and is enclosed by parts of the carrier frame which carries the cam followers that are configured as follower rolls.

3. The rotary frame construction according to claim 2, wherein the carrier frame has a base plate that extends in parallel with the cam plate and on which bearings for the follower rolls are arranged such that axes of rotation of the follower rolls are orthogonal to the base plate.

4. The rotary frame construction according to claim 3, further comprising a support plate carrying bearing axles for the follower rolls mounted on the base plate so as to rest flat on the base plate.

5. The rotary frame construction according to claim 4, further comprising brackets in which the support rollers are rotatably supported, arranged upright on one of the base plate and the support plate.

6. The rotary frame construction according to claim 2, wherein the rotary frame includes:

two parallel side walls with projecting bearing brackets for the input roller and the output roller and a plate-shaped cross-bar that connects the side walls and on which the cam plate is supported via studs.

7. The rotary frame construction according to claim 6, wherein each of the support rollers is accommodated in a slot that is formed in the other of the frames and each slot has parallel edges that form run surfaces for the support rollers.

8. The rotary frame construction according to claim 6, wherein the cam plate has projections that are in form-fitting engagement with recesses in the side walls of the rotary frame.

9. The rotary frame construction according to claim 1, wherein the drive system is self-arresting in at least one direction, and the frames are elastically biased against one another in the rotary direction in which the drive system is self-arresting.

10. The rotary frame construction according to claim 9, wherein the drive system is a linear drive that is connected to a lever of the carrier frame and the rotary frame, respectively, by articulated joints, and one of a compression spring and a tension spring is held under tension between these levers.

11. A rotary frame construction for web transport control devices, comprising:

a carrier frame, a rotary frame which extends in parallel with the carrier frame and carries an input roller and an output roller for a web to be controlled, the rotary frame being pivotably mounted on the carrier frame by a bearing having a virtual rotation center that is defined by control surfaces of one of the carrier frame and the rotary frame, cam followers on the other of the frames for riding along the control surfaces, support rollers on one of the frames and associated run surfaces on the other frame for holding the frames in parallel alignment, a drive system, with the frames being connected with one another so as to be pivotable by means of the drive system, wherein the control surfaces are constituted by three control curves that are formed at outer edges of a cam plate that is rigidly held on one of the frames, with two of the control curves being located on one side of the cam plate and the third on an opposite side of the cam plate, wherein the other of the frames has three said cam followers that are respectively associated with one of the control curves wherein the cam plate forms part of the rotary frame and is enclosed by parts of the carrier frame which carries the cam followers that are configured as follower rolls, wherein the rotary frame includes:

two parallel side walls with projecting bearing brackets for the input roller and the output roller and a plate-shaped cross-bar that connects the side walls and on which the cam plate is supported via studs, wherein each of the support rollers is accommodated in a slot that is formed in the other of the frames and each slot has parallel edges that form run surfaces for the support rollers, and further comprising at least one wall member that is trapezoidal in plan view and has legs that extend tangentially with respect to a circle around the virtual rotation center, the slots being formed in the legs of this wall member.

12. The rotary frame construction according to claim 11, comprising:

two said trapezoidal wall members that are arranged such that base lines of the trapezoids are parallel to one another and the legs of the two wall members are symmetrically arranged and form different angles with the base line, and a total of four support rollers engaging in respective ones of the slots of the wall members.

13. The rotary frame construction according to claim 12, wherein one of the wall members forms the studs for holding the cam plate.

14. The rotary frame construction according to claim 11, wherein the at least one wall member has pegs that engage in corresponding peg holes of:

a base plate of the carrier frame, the support plate of the carrier frame, the cross-bar and the cam plate, respectively.

15. A rotary frame construction for web transport control devices, comprising:

a carrier frame, a rotary frame which extends in parallel with the carrier frame and carries an input roller and an output roller for a web to be controlled, the rotary frame being pivotably mounted on the carrier frame by a bearing having a virtual rotation center that is defined by control surfaces of one of the carrier frame and the rotary frame, cam followers on the other of the frames for riding along the control surfaces, support rollers on one of the frames and associated run surfaces on the other frame for holding the frames in parallel alignment, a drive system, with the frames being connected with one another so as to be pivotable by means of the drive system, wherein the control surfaces are constituted by three control curves that are formed at outer edges of a cam plate that is rigidly held on one of the frames, with two of the control curves being located on one side of the cam plate and the third on an opposite side of the cam plate, and wherein the other of the frames has three said cam followers that are respectively associated with one of the control curves, wherein the cam plate forms part of the rotary frame and is enclosed by parts of the carrier frame which carries the cam followers that are configured as follower rolls, wherein the carrier frame has a base plate that extends in parallel with the cam plate and on which bearings for the follower rolls are arranged such that axes of rotation of the follower rolls are orthogonal to the base plate, further comprising a support plate carrying bearing axles for the follower rolls mounted on the base plate so as to rest flat on the base plate, further comprising brackets in which the support rollers are rotatably supported, arranged upright on one of the base plate and the support plate, wherein the brackets have pegs that engage in corresponding peg holes of:

the base plate, the support plate, a plate-shaped cross-bar that connects two parallel side walls with projecting bearing brackets for the input roller and the output roller and on which the cam plate is supported and the cam plate, respectively.

* * * * *